US008912456B2

(12) United States Patent
Reed et al.

(10) Patent No.: US 8,912,456 B2
(45) Date of Patent: Dec. 16, 2014

(54) ATV SWITCH ACTUATOR AND HOUSING DESIGN

(75) Inventors: Mark D. Reed, Springfield, IL (US); Al B. Cable, Springfield, IL (US)

(73) Assignee: Honeywell International Inc., Morristown, NJ (US)

( * ) Notice: Subject to any disclaimer, the term of this patent is extended or adjusted under 35 U.S.C. 154(b) by 1675 days.

(21) Appl. No.: 11/804,023

(22) Filed: May 16, 2007

(65) Prior Publication Data

US 2008/0283371 A1 Nov. 20, 2008

(51) Int. Cl.
*H01H 9/00* (2006.01)
*H01H 15/10* (2006.01)

(52) U.S. Cl.
CPC ..... *H01H 15/10* (2013.01)
USPC ..... 200/61.54

(58) Field of Classification Search
USPC ..... 200/61.54
See application file for complete search history.

(56) References Cited

U.S. PATENT DOCUMENTS 4,918,264 A 4/1990 Yamamoto et al.
5,357,070 A 10/1994 Parsons, Jr.
5,389,754 A 2/1995 Muller et al.
6,150,621 A * 11/2000 Nishitani et al. ..... 200/61.54
6,225,578 B1 * 5/2001 Kobayashi et al. ..... 200/5 R
6,344,621 B1 * 2/2002 Shiratori et al. ..... 200/61.54
6,525,283 B2 * 2/2003 Leng ..... 200/339
6,592,142 B2 * 7/2003 Landen et al. ..... 280/728.2
6,781,071 B2 * 8/2004 Leng et al. ..... 200/61.54
6,967,296 B2 * 11/2005 Kato ..... 200/61.54

FOREIGN PATENT DOCUMENTS

DE 3843650 7/1989

* cited by examiner

*Primary Examiner* — Renee S Luebke
*Assistant Examiner* — Lheiren Mae A Caroc
(74) *Attorney, Agent, or Firm* — Seager Tufte & Wickhem LLC.

(57) ABSTRACT

A switch activator device for ATVs and like vehicles operating in robust environments having a switch housing including an open back side and a front side having a central opening and at least one slots for receiving a switch actuator. At least one switch activator is mounted in the housing with a flange sized to engage the at least one slot in the housing. A central housing insert is put in the housing between the at least one activator to substantially close off the front side of the housing and provide mounting support to maintain the at least one actuator flange in the slot. Preferably the housing, actuators and insert are made by injection molding plastic.

4 Claims, 2 Drawing Sheets

ATV SWITCH ACTUATOR AND HOUSING DESIGN

FIELD OF THE INVENTION

The present invention relates to a switch housing for ATV machines and others having similar controls. More particularly, the invention relates to a switch housing for accommodating the switch actuator geometry for single piece switch actuator designs wherein the opening is closed by inserting a mechanically attached housing insert.

BACKGROUND OF THE INVENTION

The operation of an ATV requires that the user make multiple switches to control the vehicle. Multiple assemblies are needed to allow for a switch actuator in switch housings when the switch housing actuator is larger than the opening that the actuator arm of the actuator moves in.

It is desirable to minimize the number of components and it is necessary to have a robust construction for ATV use due to the vigorous use these machines encounter.

It would be of advantage in the art if a simple, effective housing for ATV switch actuators could be provided that would be rugged and easy to assemble.

Yet another advantage would be if the housing would permit a switch actuator geometry allowing for a single piece switch actuator design.

Other advantages will appear hereinafter.

SUMMARY OF THE INVENTION

It has now been discovered that the above and other advantages of the present invention may be obtained in the following manner. Specifically, the present invention provides a switch activator device for ATV and like devices operating in robust environments.

The device has at least three components. A switch housing having means for mounting on a vehicle is provided which locates the housing with respect to other components and wiring to enable the switches to function as intended. The housing has an open back side large enough to insert at least one switch actuator. The front side has central opening with slots for the number of switch actuators and is shaped to engage a switch actuator.

At least one switch activator is mounted in the housing. Each activator has the usual forward extending switch. Each actuator also includes a flange sized to engage one of the slots in the housing, and thus can be larger than the open space. Also provided is a central housing insert which fits in the housing between the activators The insert is sized to substantially close off the remaining part of the front side of the housing and supportively hold the actuator in place with their respective flanges in the slots.

In a preferred embodiment, the housing, actuator or actuators and insert are formed by injection molding plastic. Other materials such as metal can be used. Also preferred is that the back of the actuator or actuators and the insert are sized to completely close off the back opening in the housing after the parts have been inserted into the housing.

BRIEF DESCRIPTION OF THE DRAWINGS

For a more complete understanding of the invention, reference is hereby made to the drawings, wherein like numbers refer to like elements, and in which.

DETAILED DESCRIPTION OF THE PREFERRED EMBODIMENT

Figure 1:
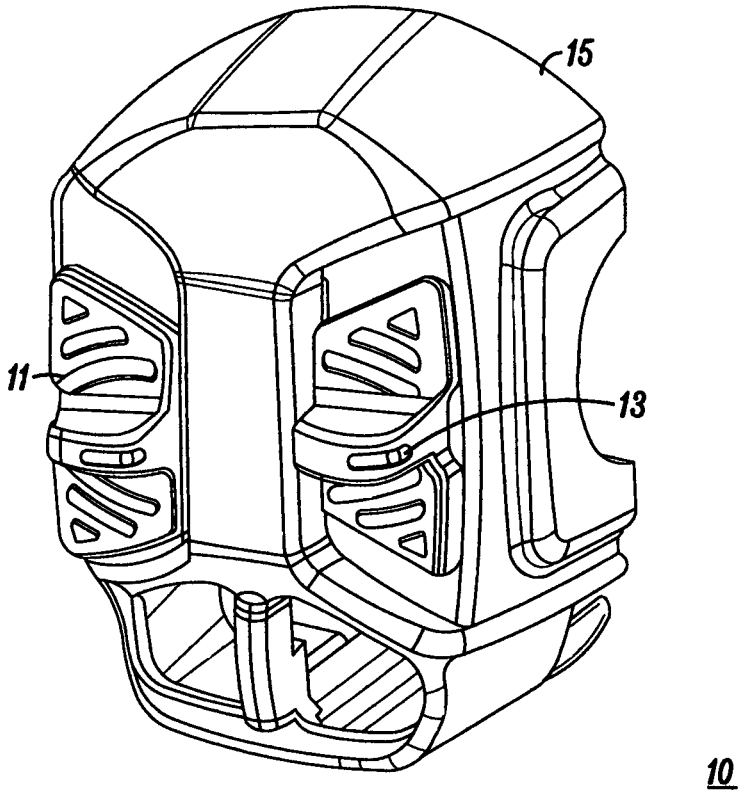
FIG. 1 is a perspective view of the present invention.

The present invention provides for substantial improvements in housing for ATVs and other rough terrain engaging vehicles. In its simplest form, the present invention incorporates an opening in the switch housing that allows for pass-through of the switch actuator geometry, allowing for a single piece switch actuator design rather than prior art designs where multipart assemblies are needed to allow for a switch actuator when the switch actuator is larger than the opening in which the actuator arm of the actuator moves. While the invention is suitable for one or more than one switch actuator, and may include four or six actuators as desired, the preferred embodiment shown in the drawings uses two switch actuators for illustration and not by way of limitation.

The fully assembled housing with switches is shown generally in FIG. 1 by reference 10. Switches 11 and 13 are fully operable.

Figure 2:
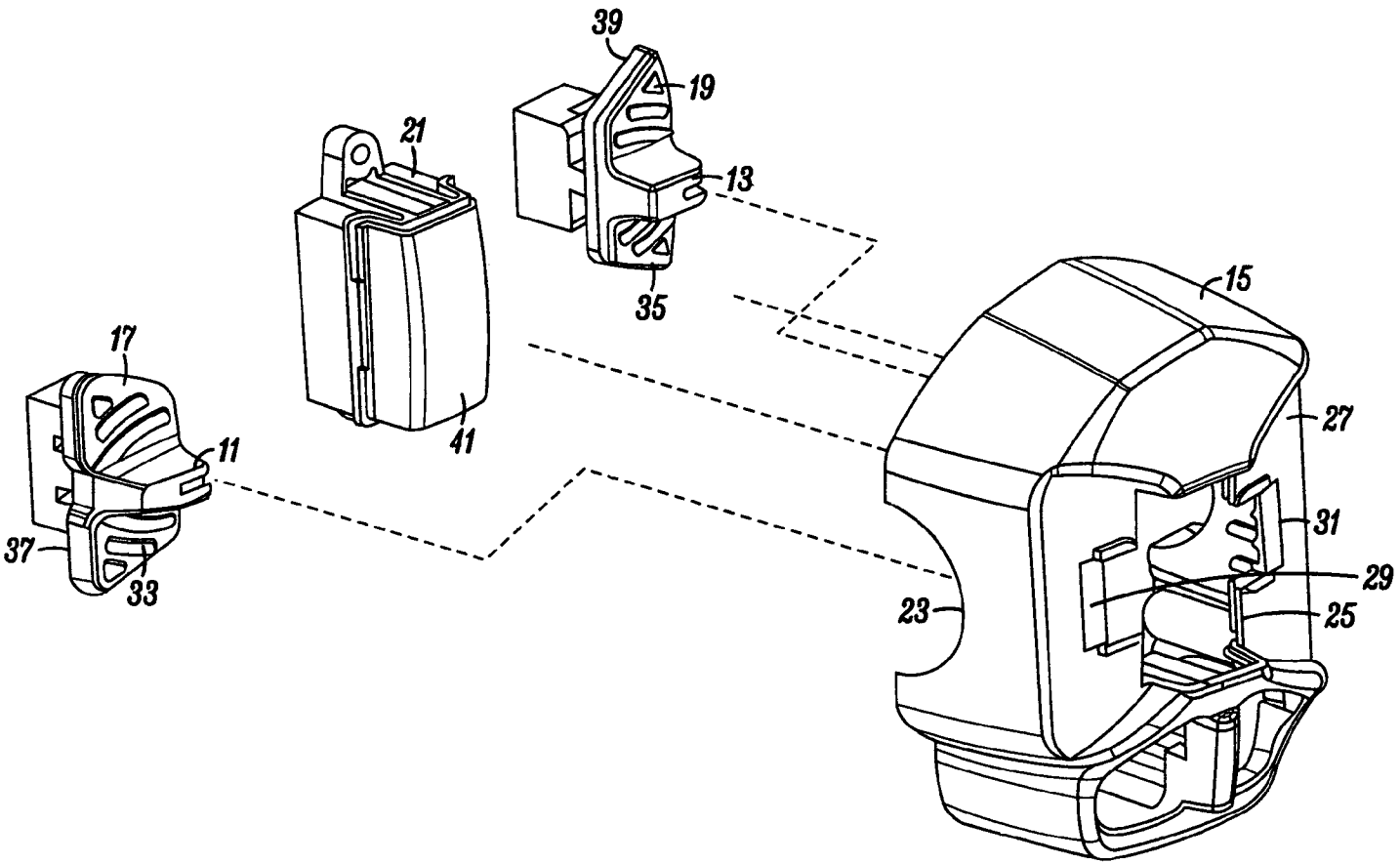
FIG. 2 is an exploded view, also in perspective, of the device in FIG. 1 prior to assembly.

In FIG. 2, device 10 is shown in an exploded view with housing 15, first switch actuator assembly 17, second switch actuator assembly 19 and insert 21. Housing 15 includes an open back side 23 and an opening 25 in the front 27 of housing 15.

Opening 25 includes a first slot 29 and a second slot 31, each disposed to the side of opening 25. Actuators 17 and 19 each have a full face, 33 and 35 respectively, which form the face of the assembly as seen in FIG. 1. The back portion of faces 33 and 35 have a flange 37 and 39 respectively that fits in slots 29 and 31 respectively. In assembly, first one switch actuator assembly 17 and then the other one 19 are inserted in the back 23 of housing 15 and extended through opening 25 and slid sideways so that flanges 37 and 39 engage slots 29 and 31.

Once the assemblies 17 and 19 are in place, an insert 21 is inserted into the back 23 of housing 15 until insert 21 engages the switch actuator assemblies 17 and 19, and also until the front 41 of insert 21 completes closure of hole 25, as seen in FIG. 1. As can be seen in FIG. 2, the backs of switch actuator assemblies 17 and 19 and the back of insert 21 are sized to close off opening 23 in housing 15. The device is ready to be used with an ATV or other similar vehicle.

While particular embodiments of the present invention have been illustrated and described, it is not intended to limit the invention, except as defined by the following claims.

The invention claimed is:

1. A method of forming a switch activator device for a vehicle operating in robust environments, comprising the steps of:

providing a switch housing, said switch housing including a back side, a front side, a central opening extending between the front side and the back side, and at least one slot extending laterally from the central opening;

inserting at least one switch activator in said central opening of said switch housing, each of the at least one switch activator having a forward extending switch portion and a flange portion, wherein the flange portion is sized to engage and cooperate with said at least one slot in said switch housing;

moving said flange of said at least one switch activator from said central opening into said at least one slot of said switch housing; and inserting a central housing insert in said central opening of said switch housing adjacent to said at least one switch activator, said central housing insert being sized to substantially close off said central opening of said switch housing and provide mounting support to maintain said flange of said at least one switch activator in said at least one slot.

2. The method of claim 1, wherein said switch housing and said central housing insert are formed from plastic.

3. The method of claim 2, wherein said plastic is injection molded plastic.

4. The method of claim 1, wherein said central housing insert is fixedly mounted in said switch housing.

* * * * *